US005389003A

United States Patent [19]

Van Steenwyk et al.

[11] Patent Number: 5,389,003

[45] Date of Patent: Feb. 14, 1995

[54] WIRELINE WET CONNECTION

[75] Inventors: Donald H. Van Steenwyk, San Marino; Michael S. Orcutt-Clenard, Atascadero; Raymond W. Teys, Pismo Beach, all of Calif.

[73] Assignee: Scientific Drilling International, Houston, Tex.

[21] Appl. No.: 119,565

[22] Filed: Sep. 13, 1993

[51] Int. Cl.[6] ..... H01R 4/60

[52] U.S. Cl. ..... 439/191; 439/194; 439/190

[58] Field of Search ..... 439/190, 191, 195, 194; 166/65.1

[56] References Cited

U.S. PATENT DOCUMENTS 2,620,029 12/1952 Turechek et al. .
3,939,705 2/1976 Glotin et al. .
4,031,969 6/1977 Cullen et al. .
4,105,279 8/1978 Glotin et al. .
4,266,613 5/1981 Boop .
4,438,996 3/1984 Zehren ..... 439/194 X
4,442,893 4/1984 Foust .
4,500,156 2/1985 Nguyen .
4,510,797 4/1985 Guidry et al. .
4,541,481 9/1985 Lancaster .
4,553,428 11/1985 Upchurch .
4,583,592 4/1986 Gazda et al. .
4,589,717 5/1986 Pottier et al. .
4,624,309 11/1986 Schnatzmeyer .
4,660,910 4/1987 Sharp et al. ..... 439/194 OR
4,685,516 8/1987 Smith et al. .
4,690,214 9/1987 Wittrisch .
4,700,778 10/1987 Smith et al. .
4,706,744 11/1987 Smith et al. .
4,736,797 4/1988 Restarick, Jr. et al. .
4,757,859 7/1988 Schnatzmeyer .
4,759,406 7/1988 Smith et al. ..... 439/194 X
4,767,349 8/1988 Pottier et al. .
4,781,607 11/1988 Rumbaugh .
4,799,546 1/1989 Hensley et al. .
4,844,161 7/1989 Rankin et al. .
4,921,438 5/1990 Godfrey et al. .
4,997,384 3/1991 Godfrey et al. ..... 439/190 OR
5,052,941 10/1991 Hernandez-Marti et al. ..... 439/194 OR
5,058,683 10/1991 Godfrey et al. .
5,107,939 4/1992 Lenhart et al. .
5,131,464 7/1992 Lenhart et al. .
5,141,051 8/1992 Lenhart .

*Primary Examiner*—Larry I. Schwartz
*Assistant Examiner*—Daniel Wittels
*Attorney, Agent, or Firm*—William W. Haefliger

[57] ABSTRACT

A releasable and reseatable electrical connection between female and male members associated with disconnectible sections of wireline used in a drill string in a borehole comprising the male member defining a first axis and having an externally exposed electrical contact ring, extending about the axis; the female member defining a second axis and having a conductive part extending at least part way about the second axis; and a spring element in electrical connection with the part and inwardly exposed for making electrical contact with the contact ring upon telescopic interfitting of the members.

12 Claims, 9 Drawing Sheets

WIRELINE WET CONNECTION

BACKGROUND OF THE INVENTION

This invention relates generally to releasable and reseatable electrical connections within boreholes, and more particularly to the connection of a wireline to a tool interface.

Wirelines having an inner electrical conductor, a coaxial insulation layer, and an outer, protective wire covering, are in common usage in boreholes for connecting subsurface electrical equipment, for example, survey or steering tools, to surface electrical equipment. Such wirelines are generally routed from the wireline reel of the surface unit through a pulley or sheave at the upper level of a drilling rig, and may enter the drill string at the upper end, either through the rotary swivel, or other circulating head connections, down to the subsurface tool.

While drilling a borehole, it becomes necessary to add drill pipe sections to the drill string. In order to achieve this, any wireline within the drill string must be withdrawn to facilitate the addition or subtraction of the drill string elements. Withdrawal of the wireline and the attached tool may not be economical or easily achievable, especially in the case of very deep or highly deviated wells. The problems are further magnified in traversing the tool and wireline back into a highly deviated borehole, and effecting a reliable oriented seat at the bottom.

Furthermore, it often becomes necessary to have a combination of motor or slide drilling, and rotary drilling, in order to drill a directionally controlled well path. For these reasons, it is highly desirable to disconnect the upper section of the wireline so that it may be withdrawn only a short distance, while leaving the subsurface tool and a length of wireline in the borehole during the addition of drill pipe sections.

SUMMARY OF THE INVENTION

The present invention provides a releasable and reseatable electrical connection within the borehole and within the drilling medium, for effecting an insulative electrical seal against the medium or any ground source. Generically, such a connection may be referred to as an "electrical wet connection".

The female (top) member is mechanically and electrically connected to the wireline, with the wireline conductor being connected to a radial contact ring supported by insulators within its bore. In this embodiment, elastomeric seal gaskets, for example of an O-ring configuration, are located such as to extrude drilling fluid as the female member is received downwardly over the male component, to seal against the intrusion of the drilling medium, and to insulate between potential ground. Also, the contacts are wiped clean during such reception.

The male (bottom) member includes an upstanding shaft fitted with a contact ring supported by insulators and positioned to coact with the female contact ring once full engagement and seating takes place. The male member may be part of, or attached to, the subsurface tool, or to a separate entity, including support mechanism to hold it at a prescribed location in the drill string, and connected to the subsurface tool by a downwardly extending length of wireline.

A still further object of the invention is to provide strength, durability, precision, and positive retention of all component parts, with radial holes in the connection apparatus providing an escape path or paths, for extrusion of drilling fluid during make-up, the outer housing being made of high-strength steel. The retained component parts can be easily removed, cleaned, and separately replaced, thus assuring absolute sealing and operation.

Yet another object of the present invention is to incorporate a tilt ring used in conjunction with weighted elements above the female member, and providing additional force to propel the wet connect female member downward, and allowing articulating freedom. It also guides and centers the entrance end of the female wet connect member to initially center itself relative to and about the male wet connect member, as for example in a highly deviated hole and to a degree approaching horizontal and beyond.

A still further object of the present invention is the improved construction of the male member body, which typically has two or more arms extending out radially and configured to have locating slots in each extremity to accept a key and to be supported by the keys of the sleeve within the drill string. The keys have rounded upper ends for matching engagement into the male wet connect body, and a tapered knife-like edge configuration for guidance of any male wet connect member below it, and also having a similar tapered leading edge, to avoid abutment on extraction from the drill pipe. The radial arm configuration presents passageways beside the male wet connect body for the free flow of drilling fluids.

These and other objects and advantages of the invention, as well as the details of an illustrative embodiment, will be more fully understood from the following specification and drawings, in which:

DRAWING DESCRIPTION

Figure 2:
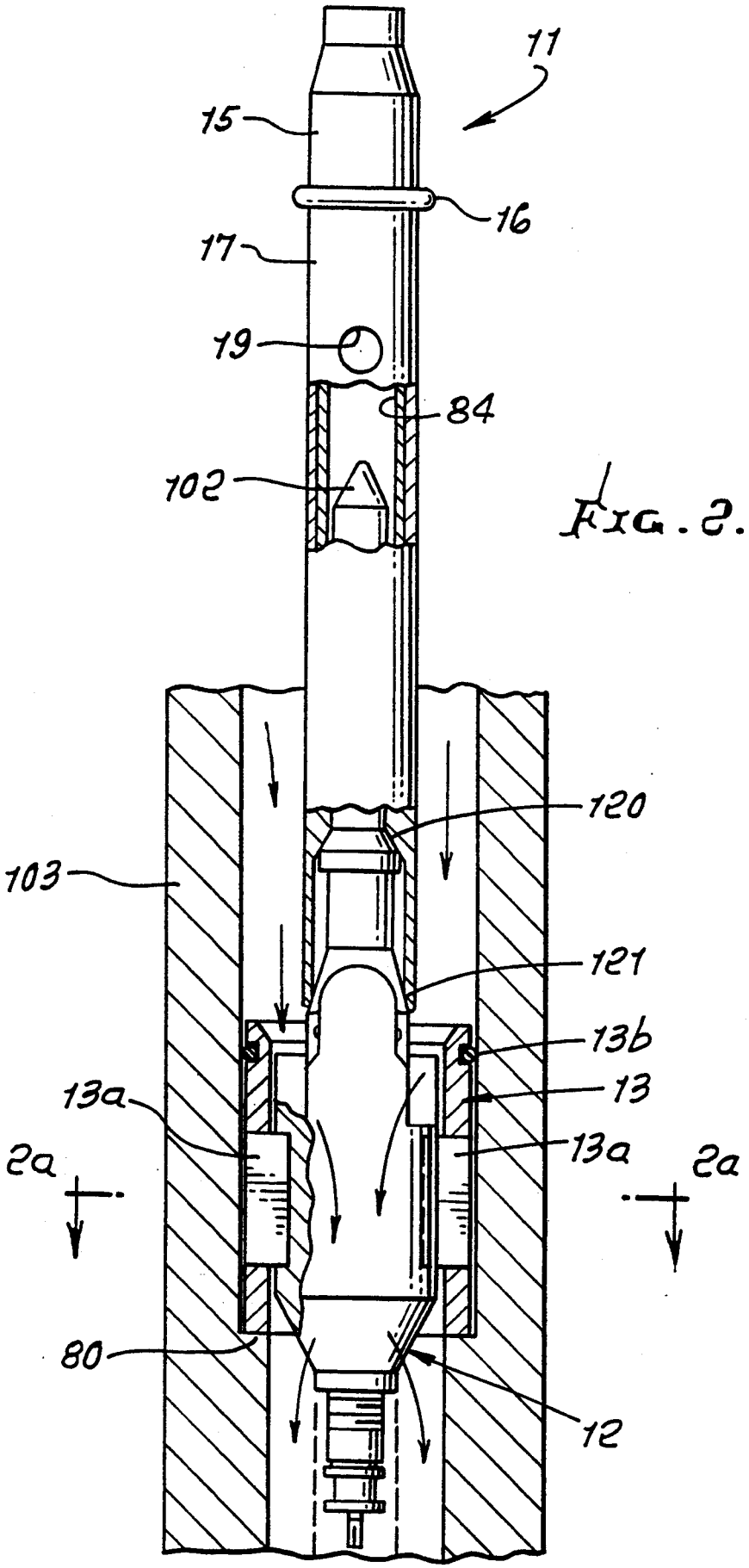
FIG. 2 is a partial and enlarged cross section taken through the wet connect members, shown mated together, and supported in a typical support sleeve within the drill string.
Figure 2A:
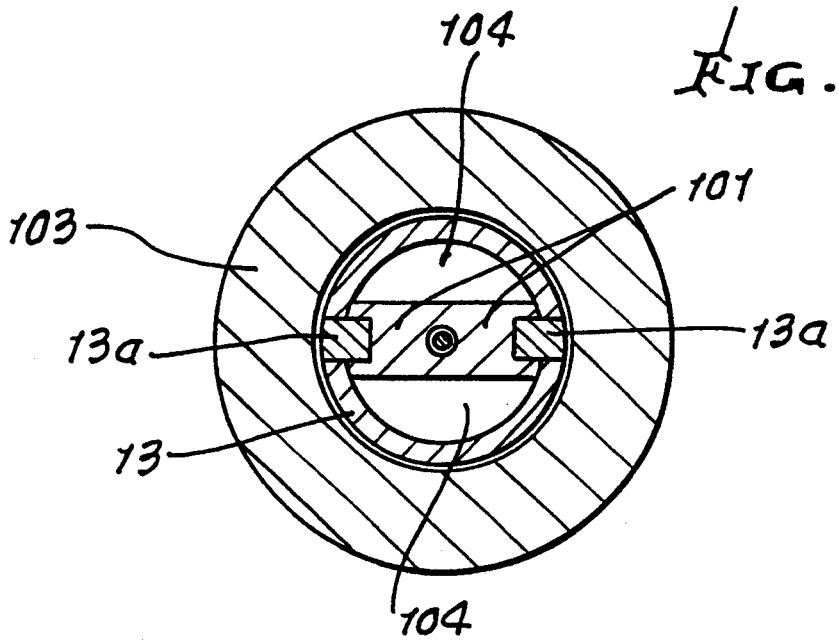
Figure 2B:
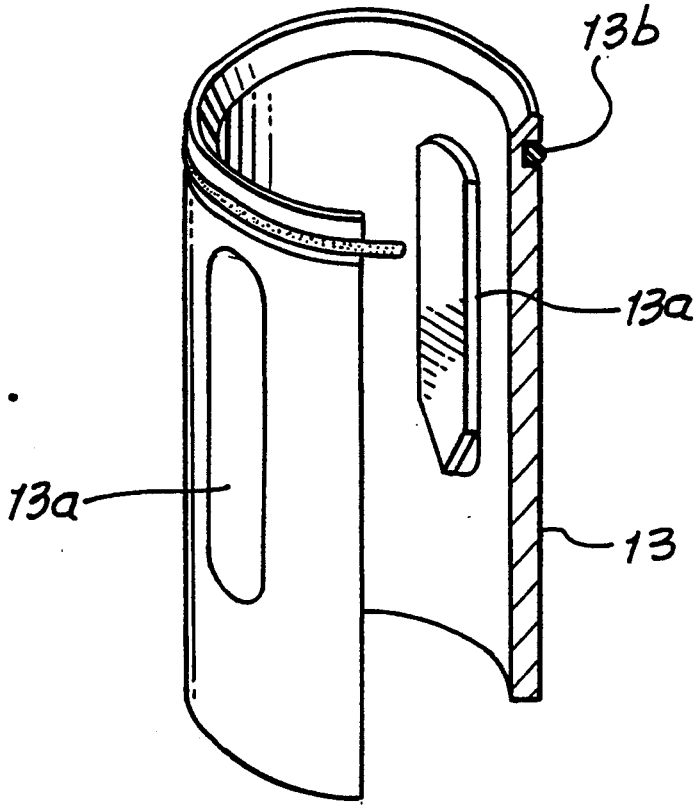
Figure 3:
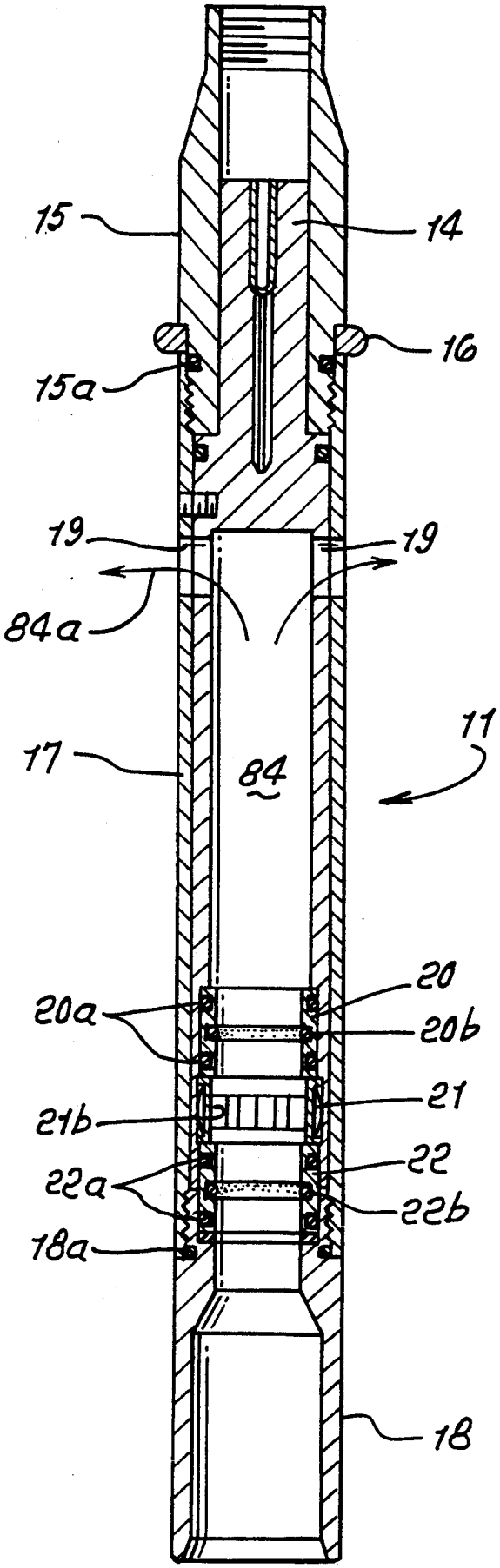
Figure 4:
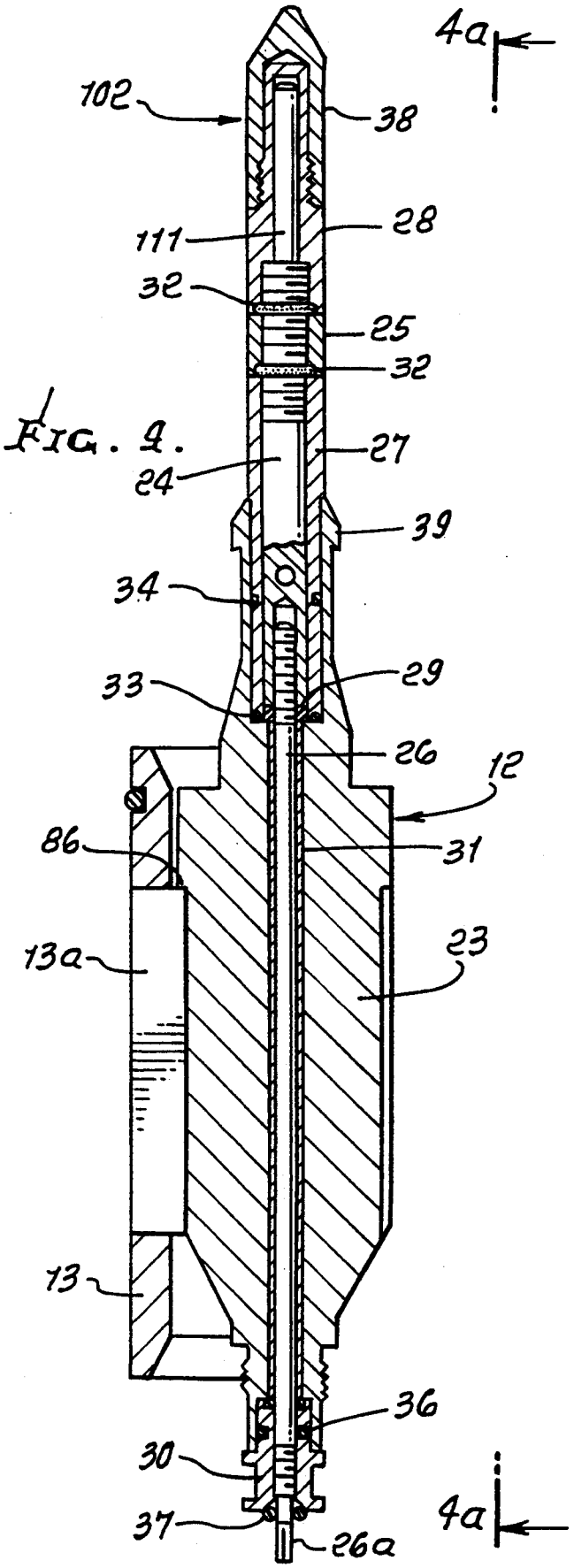
Figure 4A:
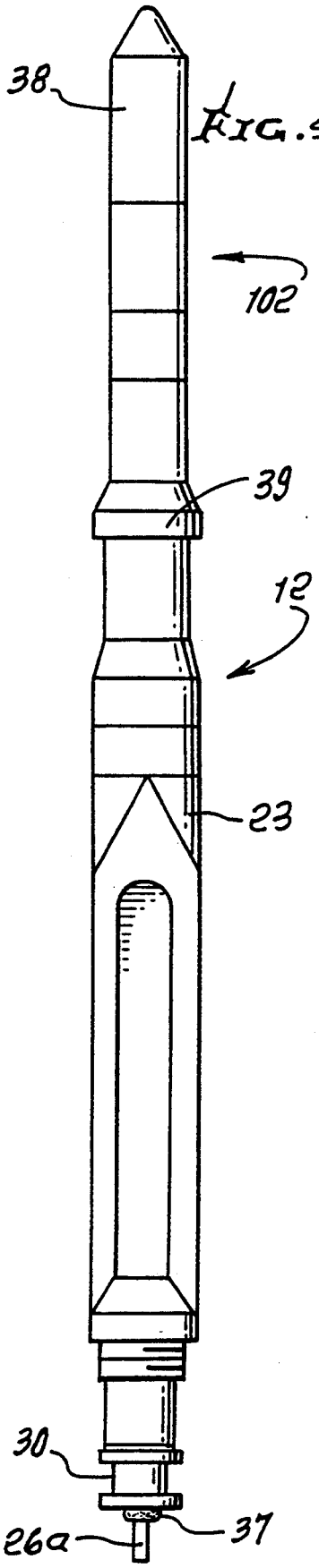
Figure 5:
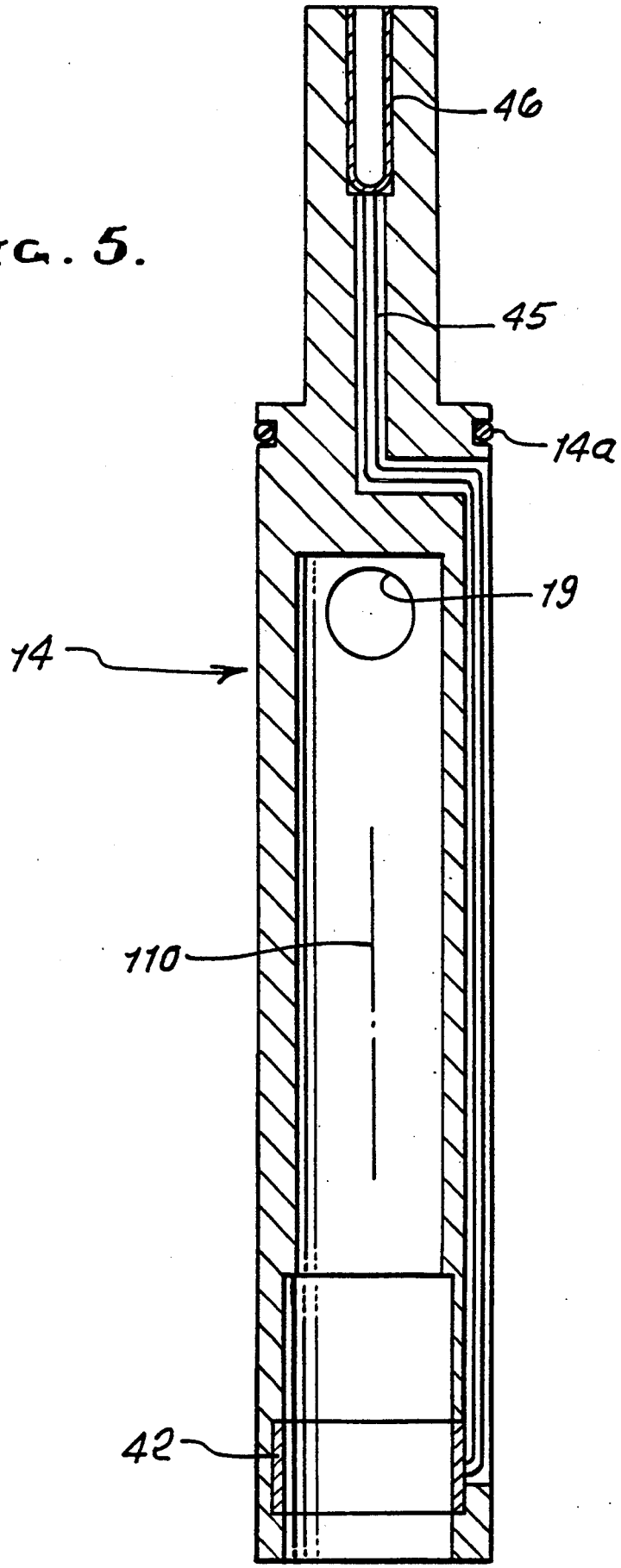
Figure 7:
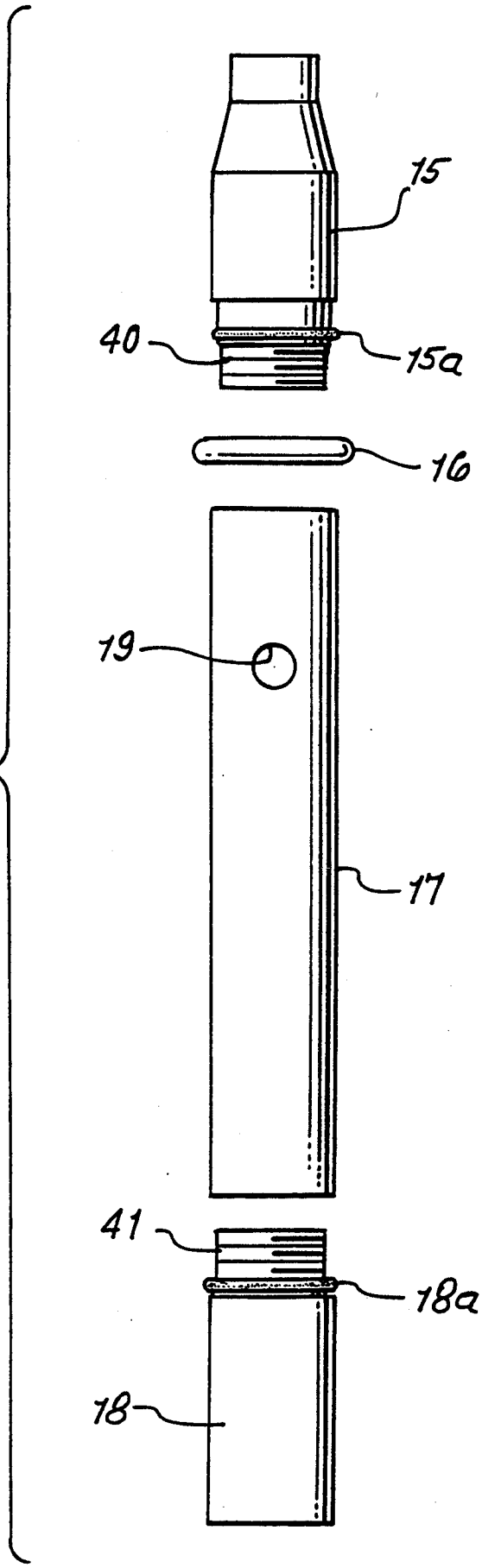
Figure 8:
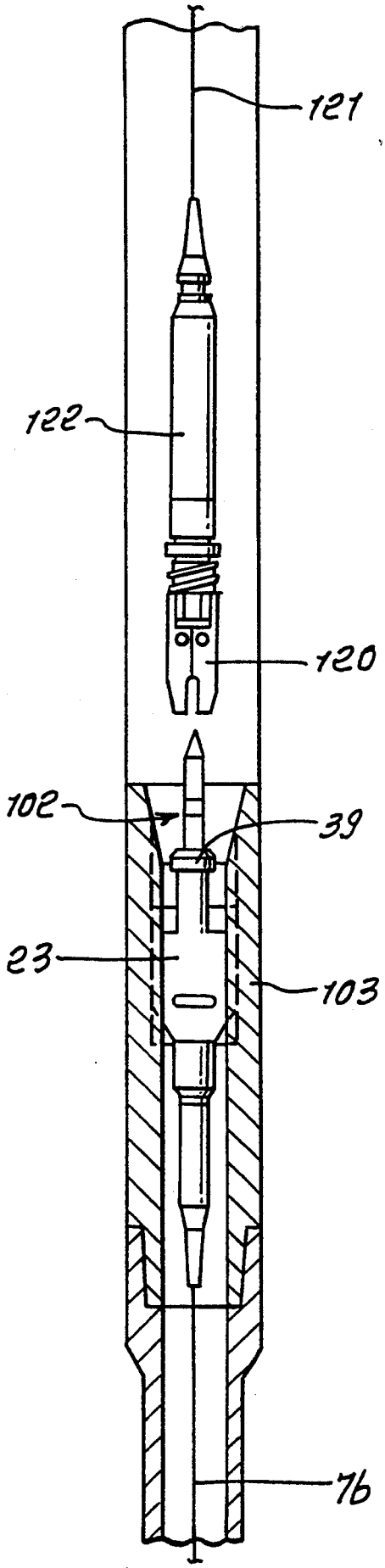

FIG. 2*a* is a section taken on lines 2*a*—2*a* of FIG. 2;

FIG. 2*b* is a perspective view of a support sleeve;

FIG. 3 is a cross section taken through the overall female member of the wet connect;

FIG. 4 is a cross section taken through the male member of the wet connect;

FIG. 4*a* is an elevation taken on lines 4*a*—4*a* of FIG. 4;

FIG. 5 is a cross section showing the insulative body of the female member together with the encapsulated electrical wiring;

FIG. 6 is a cross section showing in 6*a*, 6*b*, and 6*c* the insulative bushings and the contact ring;

FIG. 7 is an exploded view of the component parts of the outer housing of the female member; and FIG. 8 is a schematic illustration.

DETAILED DESCRIPTION

Figure 1:
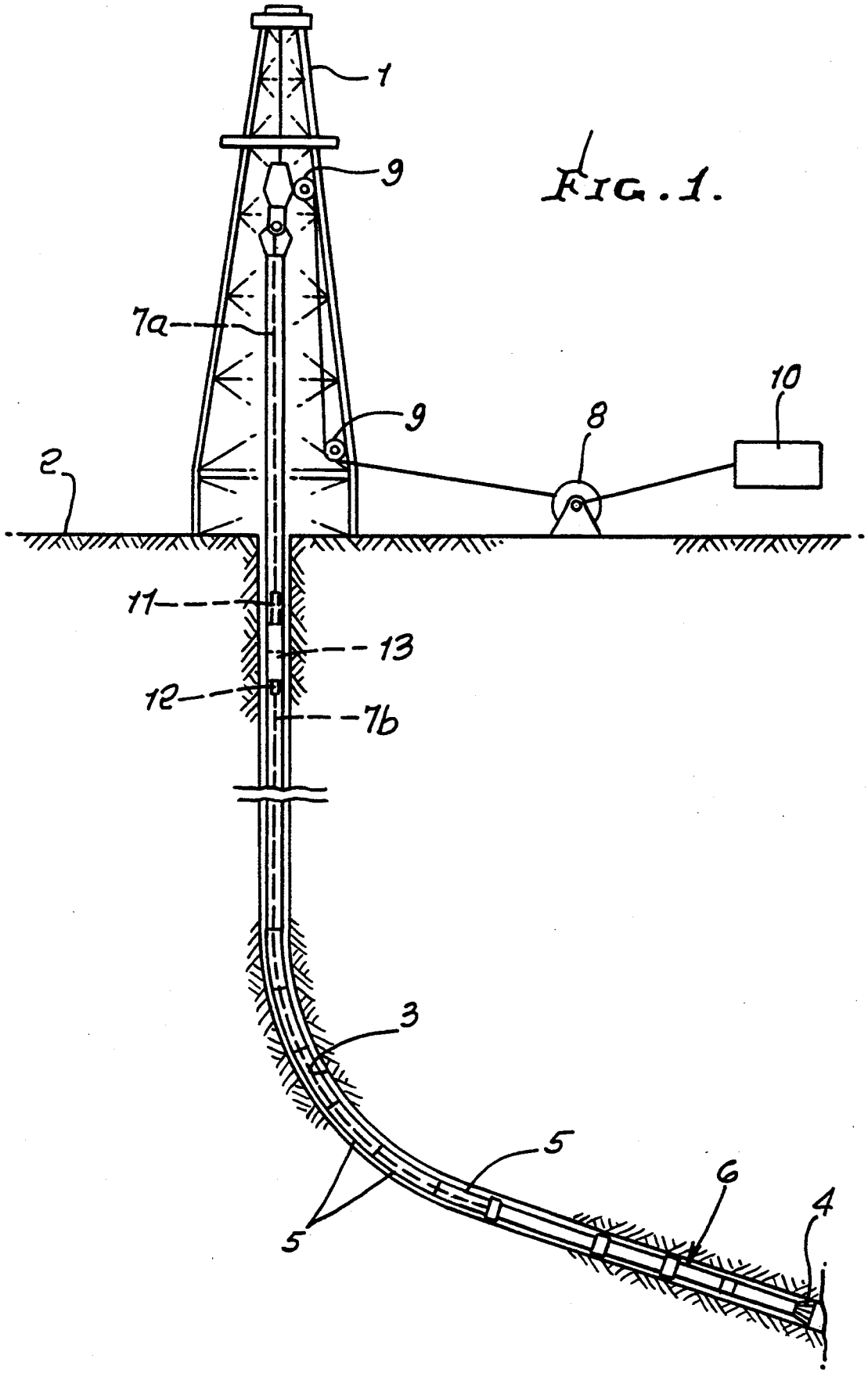
FIG. 1 is a schematic view of a borehole drilling operation showing the borehole, a wireline, the subsurface, and the surface equipment.

FIG. 1 shows a drilling rig 1 on the surface of the earth 2 for drilling a borehole 3 into the earth. The drilling is accomplished by a drill bit 4 at the bottom of the drill string made up of individual drill pipe sections 5. As part of the drill bit and drill collar assembly at the bottom of the string, a steering or survey tool 6 is provided for measuring the direction and inclination of the borehole.

An upper wireline indicated at *7a* is spooled on a reel 8, which is part of the surface equipment, and is generally controlled and operated by a motor drive. The wireline section *7a* passes over pulleys or sheaves 9 associated with the rig and extends downwardly into and through drill pipe sections 5 to a wet connection to connect to a lower wireline section *7b*, which in turn extends to the subsurface tool. The purpose of the overall wireline is to carry power and signal data between the tool 6 and the surface equipment 10. The reel 8 unwinds, playing out the wireline as the drill string penetrates further into the earth. The wireline is wound back on the reel 8 when it becomes necessary to extract it and the tool 6, allowing drill string sections to be added, or removed, from the borehole. Surface equipment 10 is connected to the wireline at the reel 8.

For several purposes, it is desirable to have a "wet connection" in the wireline that may be easily disconnected, so that only the upper section *7a* of the wireline may be withdrawn, leaving the tool 6 seated or located in place at the bottom of the drill string, but connected to the male member of a wet connect in the string near to the surface of the earth, by a length of the subsurface wireline *7b*.

FIGS. 2 and *2a* are enlarged views of the engaged wet connect assembly of the female 11 and male 12 members. The assembly is supported within the support sleeve 13 configured to accept the body of the male member into the keys *13a*. Sleeve 13 in turn seats at a shoulder 80 formed by special section 103 in the string 5.

Referring also to FIG. 3, showing the female upper member 11 in section, the insulative body 14 is assembled in the outer housing comprising components 15, 16, and 17. A sealing gasket *15a*, preferably of an O-ring configuration, is incorporated at the pin and box connection between 15 and 17, to prevent drilling fluid from entering the housing. Holes 19 are provided through the housing wall or walls for escape of the drilling fluid from body bore 84 during subsequent reception of 12 into 84. See arrows *84a*. This feature also permits self-flushing, while traversing within the drill pipe, as well as subsequent cleaning of internal components. An insulative bushing 20 is fitted with outward seals *20a* and inward seal *20b*, for example of an O-ring configuration, and inserted into the body 14. See also FIG. 6. The contact assembly 21 carried by 14 below 20 is located dimensionally over a mating contact ring *21b* encapsulated into the body 14. A second bushing 22, fitted with outward seals *22a* and inward seal *22a*, is also inserted into and carried by body 14. All items have precision fit and are positively locked in place with housing skirt 18 incorporating a sealing gasket *18a* between the pin and box connection between 18 and 14, to prevent drilling fluid from entering the housing.

Referring now to the male member 12 seen in FIG. 4, a high-strength steel body 23 fits into and is supported at shoulder 86 by the keys *13a* of a support sleeve 13 also shown in FIG. *2a*. The body 23 has two or more such key engagements providing as many passageways or openings 104 between the body arms 101 to allow circulation of drilling fluids through the drill string. See FIG. *2a*.

The body 23 houses an upwardly directed probe 102, which is centrally supported and strengthened by a conductive center rod 24. Electrical connection to the female contact is radially established at a precision contact ring 25 threaded on the center rod 24. Conductivity is further transmitted down through the body 23 by means of a conductor rod 26, threaded into the center rod 24, and terminated appropriately at the lower end, for connection to equipment below it.

The conductive components 24, 25, and 26 are insulated from the body 23, and other ground potentials by insulators 27, 28, 29, 30, and 31, each of which is made of an insulating material, such as PEEK, later referenced in this text.

The insulator sleeve 27 is precision fitted about and screwed onto the center rod 24 with a gasket 32, preferably of an O-ring configuration, making a leak-tight seal with the contact ring 25. The insulator cap 28 is precision fitted about the upper part of the center rod 24, thread connected to it, and sealed in a like manner to the insulator sleeve 27, with a gasket 32.

The insulated center rod 24 is further insulated by means of an insulative spacer 29 and sealed with a gasket 33, preferably of an O-ring configuration. In this embodiment, a second radial gasket 34 is optionally employed in similar manner.

The conductor rod 26 may be insulated with material, such as DuPont polytetrafluoroethylene (TFE) Teflon tubing 31. The rod 26 is further insulated at its lower or exit end *26a* with an insulator nut 30, sealed with a gasket 36, preferably of an O-ring configuration. In this embodiment, a second radial gasket 35 is optionally employed in the same manner.

A similar seal gasket 37 is provided for subsequent sealing to any attachment designed for the application.

The probe upper extremity is equipped with a protective cap or helmet 38 screwed onto the uppermost insulator cap 28, manufactured of a hard, high-strength material for strength and durability. The helmet 38 is conical in shape at its upper end to assist in centering during reception into wet connect female member 11. At that time, drilling fluid in bore 84 of member 11 is squeezed out via passages 19.

The body 23 is additionally equipped with a fishing neck or flange configuration at 39, to facilitate retrieval using either a conventional "overshot" in usage in the industry, but modified with an enlarged cylindrical recess to accept the elongated probe section 25, or by a specially fitted overshot designed for the present application.

FIG. 5 shows an axial cross section of the insulative body 14 of the female member rotated relative to FIG. 3, to illustrate the electrical conductor 45 routing from the upper electrical connection point 46 (to wireline *7a*) to the contact ring 42 embedded within its lower confines. See also FIG. 7 which also illustrates the aforementioned radial exhaust ports or holes 19 for the drilling fluid to escape.

The body 14 is made from an insulating material having excellent electrical insulating properties, mechanical strength, and dimensional stability at the elevated temperatures that may be encountered in boreholes. One suitable material is Victrex PEEK 450GL30, available from the Polymer Corporation, P.O. Box 422, Reading, Pa. This material consists of glass fiber-filled polyetheretherketone.

Figure 6A:
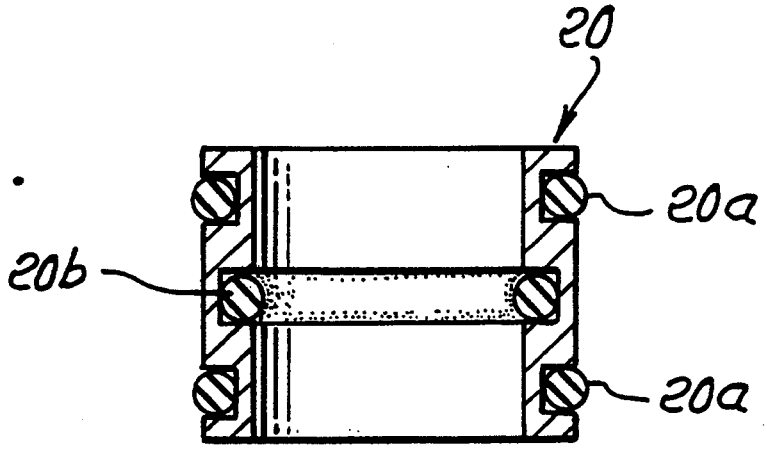
Figure 6B:
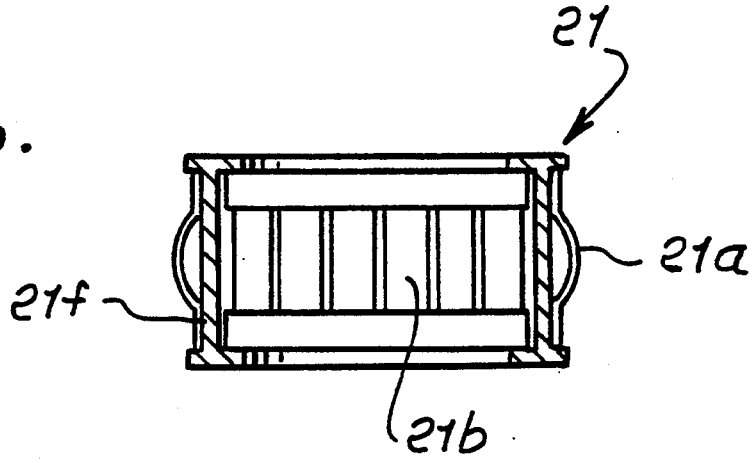

Elements *6a* to *6c* of FIG. 6 are now referred to. FIG. *6a* shows an axial cross section of the insulative bushing 20, together with its gasket seals *20a* and *20b*, as used above the FIG. *6b* contact ring 21 for positioning and sealing purposes. The conducting ring 21 as illustrated in FIG. 6*b* consists of a bow spring element 21*a* wrapped about a conductive cylinder 21*f*, and bowed outwardly to make positive pressural electrical contact with the contact ring 42 embedded in the insulative body 14, and a conductive inner spring element 21*b* captive within the inner diameter of the cylinder, and bowed toward the second axis 110. Once engaged, the inner spring element 21*b* makes absolute electrical contact with the mating and coacting contact ring 25 of the male probe member, extending about the male member first axis 111. Axes 110 and 111 align during make-up.

Figure 6C:
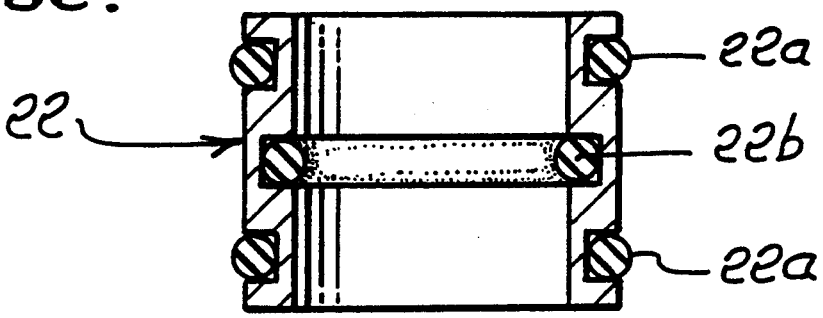

FIG. 6*c* shows an axial cross section of an insulative bushing 22, like that of FIG. 6*a*, together with its gasket seals 22*a* and 22*a*, for use below the contact ring 21, for positioning and sealing. Seals 20*b* and 22*a* wipe and seal against the outer cylindrical surface of the probe 102 and protect 21*b* and 25. The bushings 20 and 22, made of the insulating material PEEK, are identical to that used in the body 14, and incorporate their respective sealing gaskets of an O-ring configuration to seal against the body 14 and provide a wiping seal for the male probe member, both above and below the conducting ring engagement.

FIG. 7 shows a view of the external housing component parts, including rope socket 15, tilt ring 16, housing 17, and skirt 18. The rope socket 15 in this embodiment has a special rope end configuration, and is screwed (see thread 40) into the housing 17 capturing the tilt ring 16 between them, and incorporating a seal gasket 15*a*. The skirt 18 is screwed (see thread 41) in place into the housing 17 lower end, after all the internal components are assembled to the housing 17. A seal gasket 18*a*, like 15*a*, is employed to seal off between 18 and the lower end of 17. These outer housing components precisionally confine the electrically insulating and conducting components, providing a cylindrical high-strength metallic housing. The external tilt ring coacts with and allows the female member 11 to self center, relative to the housing in both near vertical and highly non-vertical, i.e., deviated boreholes.

In operation, the member 12 is carried by the support sleeve 13 in a vertical section of the drill string, near, i.e., below the drilling rig. The member 13 is lowered in the bore of the string section to receive the member 12 and any drilling fluid therebetween is squeezed out endwise during make up. Seating occurs at mating conical surfaces seen at 120 and 121 in FIG. 2. The contact ring 25 is thereby brought into engagement with the inner spring element 21*b* on 13, to establish electrical contact, despite a film of fluid adjacent these elements. The wireline is, accordingly, brought into operative connection, for power and signal data transmission, member 12 being connected via wireline 7*b* to 6.

When drill string is to be removed from the hole, the upper wireline 7*a* is pulled up, detaching member 13 from member 12, and removing 13 from the upper string section. An overshot can then be lowered to connect to member 12, as via neck 39 as referred to above, so that the wireline can be removed. Then, all the drill string sections can be pulled from the hole.

FIG. 8 schematically shows an overshot 120 being lowered on a line 121 to attach neck 39, as referred to above. Overshot body 122 is connected to 121.

We claim:

1. A releasable and reseatable electrical connection between female and male disconnectible sections of wireline in a drill string in a borehole, the invention comprising:

a) the male member defining a first axis and having an externally exposed electrical contact ring, extending about said axis, b) the female member defining a second axis and having a conductive part extending at least part way about said second axis, and a spring element in electrical connection with said part and inwardly exposed for making electrical contact with said contact ring upon telescopic interfitting of the members, said spring element outwardly bowed substantially perpendicular to said drill string to make contact with said part, (c) and including seals carried by insulative bushings received by the female member above and below said spring element, to protect said part, said element and said contact ring during inter-fitting of said members, the seals located to wipe against the outer surface of said male member.

2. The combination of claim 1 including a housing for the female member and carrying a tilt ring to cooperate with the drill string for allowing self centering of said housing and alignment with the used member.

3. The combination of claim 1 wherein said insulative bushings are carried by the female member and extend about said second axis above and below said conductive part for locating engagement with the male member upon said telescopic interfitting.

4. The combination of claim 1 wherein said conductive part is annular, and said spring comprises a bowed element carried by said annular part to tightly engage said contact ring.

5. The combination of claim 1 including a support sleeve and key assembly supporting said male member body to seat on a shoulder within said drill string.

6. The combination of claim 5 wherein the key assembly defines guide edges engageable with arms on the male member body and spaced to define passageways for flow of drilling fluid past the key assembly and male member body.

7. The combination of claim 6 wherein the male member defines an axially elongated probe above said body and carrying said contact ring, there being a support sleeve supporting said male member below said contact ring.

8. The combination of claim 7 including insulative material outwardly exposed on the probe, above and below said contact ring, and an electrically conductive path protectively confined within the probe and body to electrically connect with an instrument in series with the wireline in the borehole below the male member.

9. The combination of claim 1 including a fishing neck on the male member, below said contact ring.

10. The combination of claim 1 wherein the male member includes an upwardly longitudinally projecting probe supporting the contact ring, and a body supporting the probe, the body having support arms projecting laterally radially to be supported by a sleeve in the drill string, and there being longitudinally extending passageways formed between the arms to pass drilling fluid.

11. The combination of claim 1 including an electrically conductive path on the female member and extending between said conductive part and a conductive terminal at the top of the female member, there being an exhaust port on the female member and communicating between a bore in said member and the exterior, above said conductive port, to exhaust drilling fluid upon reception of said male member into said bore.

12. The combination of claim 1 including wireline connected with said male member and extending downwardly in the string in the borehole, and a steering tool electrically connected with said wireline.

* * * * *

UNITED STATES PATENT AND TRADEMARK OFFICE

CERTIFICATE OF CORRECTION

PATENT NO. : 5,389,003

DATED : February 14, 1995

INVENTOR(S) : Donald H. Van Steenwyk et al

It is certified that error appears in the above-identified patent and that said Letters Patent is hereby corrected as shown below:

Column 5, line 67; "wireline in a drill string in a borehole, the invention" should read --wireline in a drill string in a borehole, the combination--

Column 6, line 21; "housing and alignment with the used member." should read --housing and alignment with the male member.--

Signed and Sealed this

Thirteenth Day of June, 1995

Bruce Lehman

*Attest:*

BRUCE LEHMAN

*Attesting Officer*

*Commissioner of Patents and Trademarks*